United States Patent [19]

Hoshino

[11] 4,216,695

[45] Aug. 12, 1980

[54] FASTENER FOR CYMBAL MOUNTING

[75] Inventor: Masao Hoshino, Owariasahi, Japan

[73] Assignee: Hoshino Gakki Seizo, Inc., Aichi, Japan

[21] Appl. No.: 930,158

[22] Filed: Aug. 2, 1978

[30] Foreign Application Priority Data

Aug. 6, 1977 [JP] Japan ..... 52-105578

[51] Int. Cl.[2] ..... G10D 13/06; G10G 5/00

[52] U.S. Cl. ..... 84/421; 85/32 R; 248/558; 248/636

[58] Field of Search ..... 84/421, 422, 251, 327, 84/379, 385 A, 385 B, 387 A, 434–435, 403, 406, 453; 85/32 R, 32.1; 308/237 A; 403/4, 259; 248/558, 636

[56] References Cited

U.S. PATENT DOCUMENTS

| | | | |
|---|---|---|---|
| 1,607,769 | 11/1926 | Meyer | 84/421 |
| 1,734,184 | 11/1929 | Stoler | 85/32 R |
| 3,705,528 | 12/1972 | Cordes | 84/422 R X |
| 3,994,198 | 11/1976 | Herman | 84/422 R X |

*Primary Examiner*—Lawrence R. Franklin
*Attorney, Agent, or Firm*—Alexis Barron

[57] ABSTRACT

A one-piece reversible fastener for mounting cymbals to cymbal stands. The fastener includes a cymbal retaining flange portion intermediate a long sleeve portion and a short sleeve portion, and means to selectively attach the fastener either long sleeve portion or short sleeve portion first to the stand to provide a "loose" or "mute" cymbal playing option. The retaining flange portion can be suitably tapered to improve fastener performance, and provided with notches or grooves to make gripping easier.

14 Claims, 5 Drawing Figures

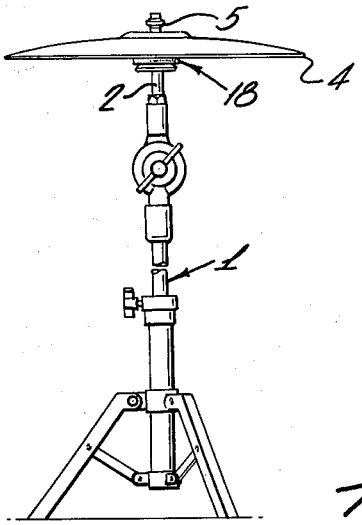
Fig. 1.
Fig. 2.
(PRIOR ART)
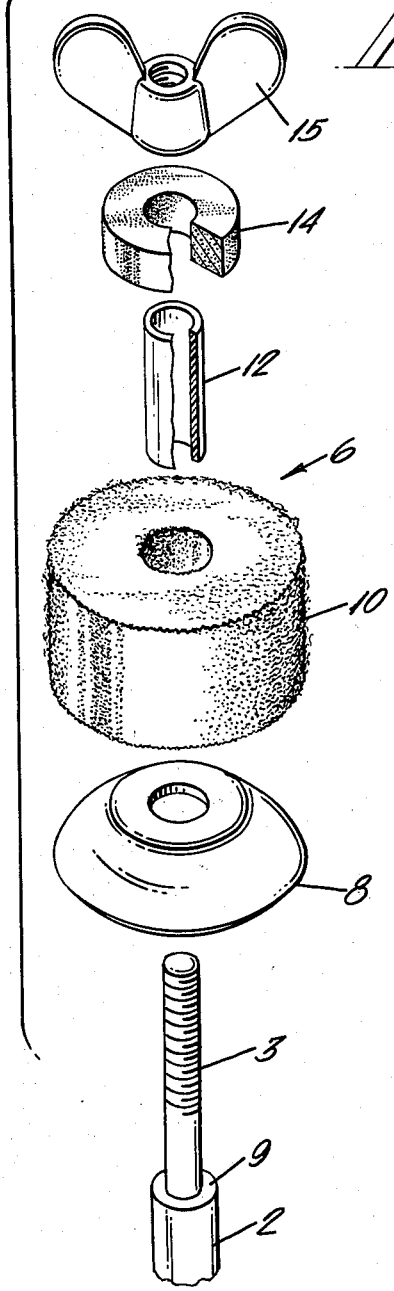
Fig. 3.
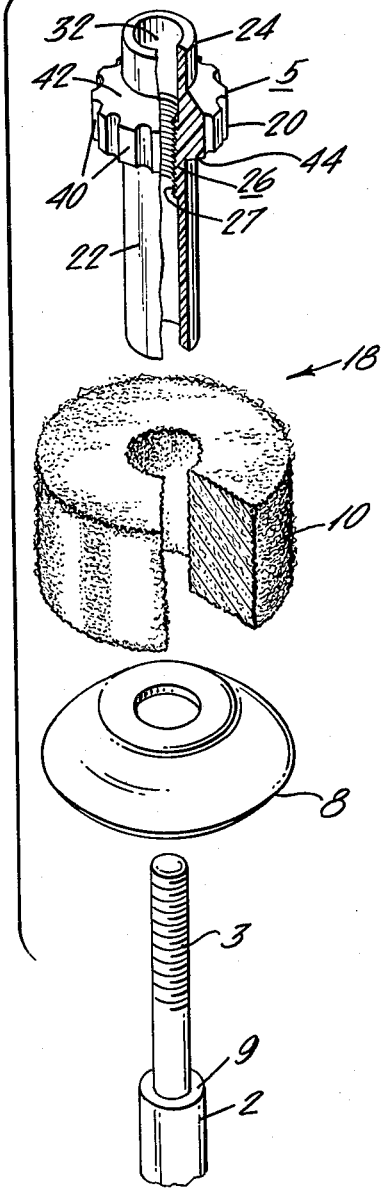

FASTENER FOR CYMBAL MOUNTING

TECHNICAL FIELD

The invention relates to musical instruments of the percussion type and more particularly involves a novel fastener for mounting a cymbal or similar device onto a drum or other suitable support.

BACKGROUND AND THE PRIOR ART

The general arrangement for mounting a cymbal onto a drum or other suitable support includes a rod or post which terminates at its upper extremity in a reduced threaded end portion over which the cymbal is fitted and secured in place by a washer and wing nut or other suitable fastening and retaining means.

In a typical mounting arrangement, a washer-like rounded metal disc or cup is fitted against a small shoulder on the rod. A felt washer or pad rests on the cup. The rod is covered by a rubber or plastic sleeve. The central hole of the cymbal is fitted over the rod around the sleeve, and the cymbal rests above the felt pad, supported by the metal cup. A rubber or leather spacing washer is positioned over the rod above the cymbal, and a wing nut is screwed down against the spacing washer.

The wing nut fastener configuration just described has several drawbacks. Cymbals are usually removed from their stands for transporting musical equipment from one location to another, and in the accompanying mounting and disassembly process the multiplicity of small fastening pieces—wing nut, plastic sleeve and washer—are inconvenient to use and can easily become lost. Furthermore, because the wing nut is usually a separate piece from the plastic sleeve and washer, it tends to loosen during cymbal playing.

Sometimes a musician may want to play a cymbal in a "loose" mode to produce a reverberating sound with the cymbal held freely and loosely by the fastener. Other times the musician may prefer to play the cymbal in a "mute" or "choked" mode to produce a muted sound with the cymbal tightly clamped by screwing the wing nut tightly to the stand. Though the wing nut fastener arrangement offers the choice of either mode of playing, separate long and short sleeve elements are needed to provide this option, and there is a tendency for the vibrations of the reverberating cymbal to loosen the wing nut during the "loose" mode of playing.

Some modifications of the general cymbal fastener arrangement described above are shown in Kiemle, U.S. Pat. Nos. 2,163,949; Gaylor, 3,336,827; Cordes, 3,705,528; and Herman, 3,994,198. These devices disclose cymbal fasteners directed toward overcoming the inconvenience of the standard wing nut fasteners during cymbal mounting and disassembly. However, unlike the wing nut fastener, these modified devices do not offer the option of playing the cymbal in either a "loose" mode or a "mute" mode.

OBJECTS, ADVANTAGES AND SUMMARY OF THE INVENTION

An object of the invention is the provision of a one-piece reversible cymbal mounting and fastener device that uniquely combines the advantages of both the selective playing mode option of the standard wing nut fastener and the greater convenience of the modified fasteners disclosed in the referenced patents. The invention offers the further advantage over conventional devices of being able to hold a cymbal in a "loose" playing mode without loosening from the vibrations.

The invention comprises a reversible fastener for mounting a cymbal or like instrument to a cymbal stand or other suitable support. The fastener includes a cymbal retaining flange portion intermediate a long sleeve portion and short sleeve portion, and means to selectively attach the fastener either long sleeve portion or short sleeve portion first to the cymbal stand. For "loose" playing mode cymbal mounting, the fastener attaches to the stand with the long sleeve portion toward the stand; for "mute" or "choked" playing mode cymbal mounting, the fastener attaches to the stand with the short sleeve portion toward the stand. The fastener of the invention can be made in one piece thereby replacing sleeve, spacer washer and wing nut of conventional cymbal fasteners and thus alleviating much of the inconvenience of handling many different parts during cymbal mounting and disassembly. The fastener can be made of a resinous material to permit the musician to trim the long and short sleeve portions to suit his individual preferences and desired playing mode options. The cymbal retain-flange portion can be tapered to accommodate cymbals of varying center hole sizes and to improve fastener performance in both "loose" and "mute" playing mode fastener positions. Also, a peripheral edge of the retaining flange portion can be notched or grooved to facilitate grasping by hand.

Some of the many objects, features and advantages of the invention will become apparent from the detailed description of a preferred embodiment of the invention, set out by way of example, with reference to the accompanying drawings, in which:

BRIEF DESCRIPTION OF DRAWINGS

FIG. 1 is a side elevation view of a cymbal mounted on a conventional cymbal stand by means of a fastener incorporating the principles of the invention.

FIG. 2 is an exploded view of a prior art wing nut fastening arrangement showing the separated elements, some of which have fragments removed to show internal structure.

FIG. 3 is an exploded view of a fastening arrangement using the preferred embodiment of the invention, shown with some elements having fragments removed to show internal structure.

BEST MODE FOR CARRYING OUT THE INVENTION

Figure 4:
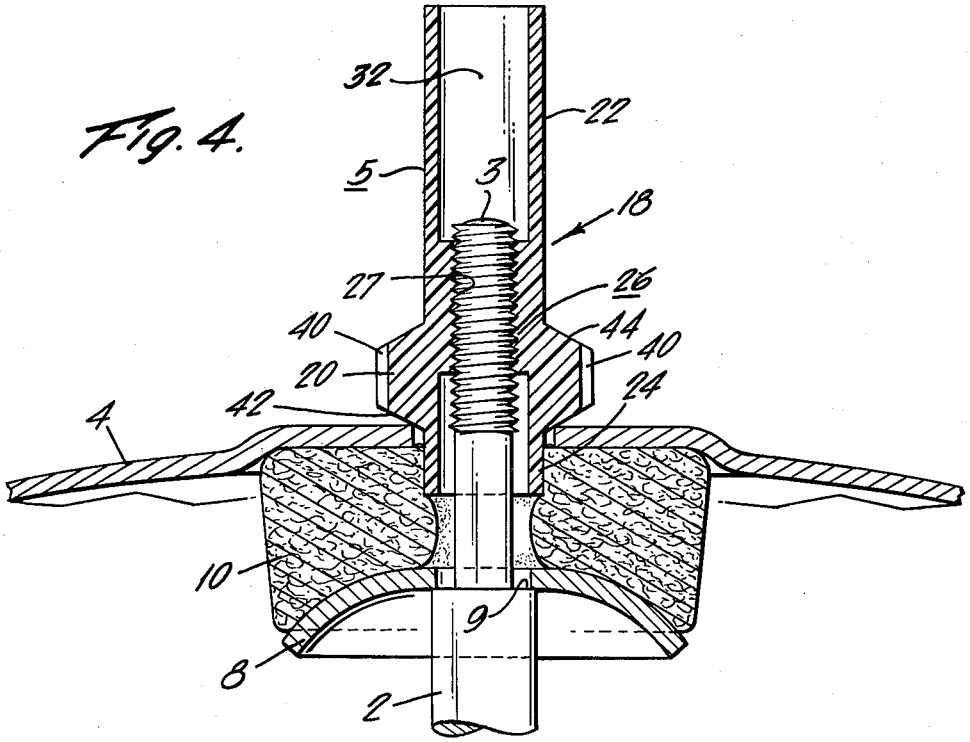
FIG. 4 is a cross-section view of the cymbal fastener of the present invention deployed in the "mute" playing mode.

To illustrate a preferred embodiment of the fastener of the invention, its details are described in terms of use with a conventional cymbal stand 1, as shown in FIG. 1. Such a stand typically includes a rod or post 2 which terminates at its upper extremity in a reduced threaded end portion 3 (seen in FIGS. 2 through 5) over which a standard cymbal 4 can be fitted and secured in place by the fastener 5.

For purposes of comparison, FIG. 2 illustrates the components of a conventional wing nut fastening arrangement 6 which is generally used in the music industry to secure the cymbal 4 in place on the conventional stand 1. In the illustrated arrangement, a washer-like rounded metal disc or cup 8 is fitted against a small shoulder 9 on the rod 2. This serves as the support for the cymbal 4. A felt washer or pad 10 is fitted over the reduced end portion 3 of the rod 2 so that it rests on the cup 8. This serves as a buffer to cushion the cymbal 4. A rubber or plastic sleeve 12 is placed around a threaded portion 3 of rod 2 reaching into the central opening of felt pad 10, so that the bottom end of the sleeve rests on cup 8. The sleeve 12 serves to isolate the metal periphery of the central hole of the cymbal 4 from contacting the threads 3 of the post 2 during playing, thereby preventing both frictional damage and the production of undesirable buzzing sounds. The central hole of the cymbal 4 surrounds sleeve 12, the cymbal resting on top of felt pad 10. The cymbal 4 is held secure to the stand 1 by means of rubber or leather spacing washer 14 and internally threaded wing nut 15 which is brought into threaded engagement with the top of the cymbal stand reduced threaded end portion 3. A "loose" or "mute" playing mode option is obtained with the conventional arrangement of FIG. 2 by the use of separate long and short sleeve elements 12 (only one of which is shown). When a musician wishes to play the cymbal in a "loose" playing mode wherein the cymbal 4 is free to vibrate, the long sleeve element 12 is placed around threaded portion 3 of rod 2. This gives the cymbal 4 room to move up and down loosely on the sleeve. If the musician chooses to play the cymbal in a "mute" mode, then the short sleeve element 12 is placed around threaded end portion 3 of rod 2. The wing nut 15 is then threaded down onto end portion 3 and the cymbal 4 is clamped tightly in muted fashion between spacing washer 14 and cup 8 with felt pad 10 being compressed.

Figure 5:
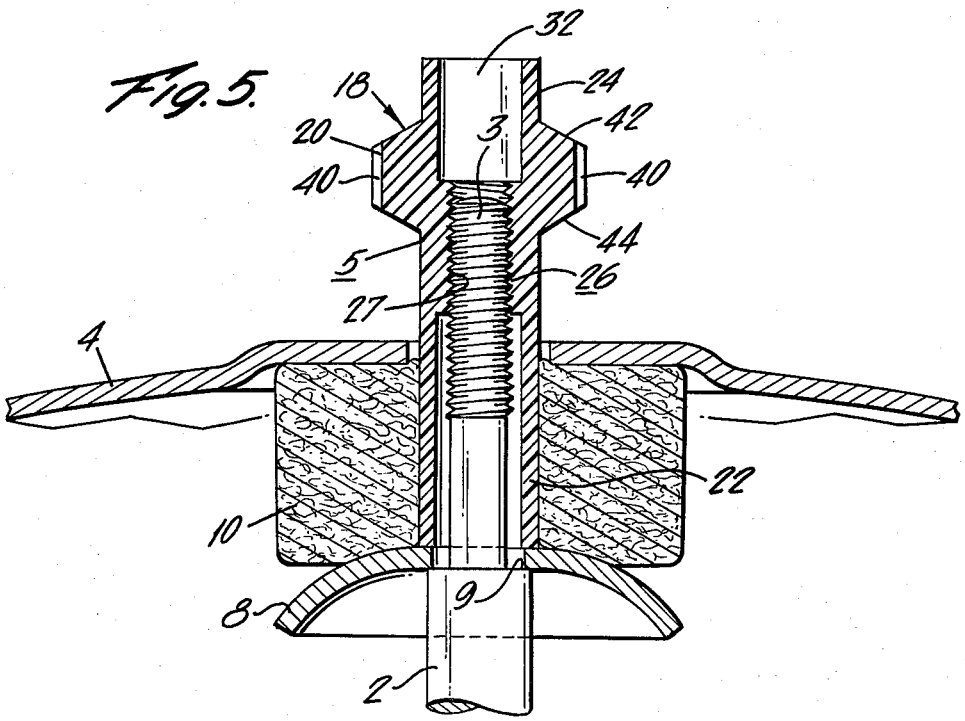
FIG. 5 is a cross-section view of the cymbal fastener of the present invention deployed in a "loose" playing mode.

A novel fastening arrangement 18 for fitting and securing cymbal 4 in place on a conventional cymbal stand 1 which utilizes the principles of the invention is illustrated in FIGS. 3, 4 and 5. FIG. 3 illustrates the fastener 5 of the invention and further shows the manner in which it cooperates with the conventional cup 8 and felt pad 10 components. The fastener 5 has a cymbal retaining flange 20 intermediate a long sleeve portion 2 and a short sleeve portion 24. Preferably, sleeve portions 22 and 24 and retaining flange 20 are formed as coaxially aligned hollow cylinders with central bore 32. Means 26, shown in FIGS. 3, 4 and 5, is included in the fastener for selective engagement of the fastener with the reduced threaded end portion 3 of the stand 1, with either long sleeve portion 22 or short sleeve portion 24 toward the cup 8.

For simplicity and ease of manufacture, flange 20, long sleeve portion 22, short sleeve portion 24, and attachment means 26 are preferably integrally formed into a single, unitary fastener 5 made of one material, although these elements can also be separately formed and suitably bonded or attached to each other. The means for selective interconnection of the fastener to the rod comprises internal threads 27 which are located centrally of the bore 32 and which are designed to mate with standard threading found on reduced threaded end portions 3 of conventional stands 1.

The outer diameters of long sleeve portion 22 and short sleeve portion 24 are selected so that they can fit snugly within the central hole of a standard cymbal 4. The external diameter of retaining flange 20 is selected so that it is larger than the central hole of a standard cymbal 4.

The manner and use of the fastener can be seen most clearly by an inspection of FIGS. 4 and 5.

FIG. 4 illustrates the fastener 5 threadably engaged with stand end portion 3 for playing a cymbal 4 in a "mute" mode. Here it is seen that short sleeve portion 24 of fastener 5 is adjacent cup 8, with the cymbal being retained between flange portion 20 and cup 8 while resting on compressed felt pad 10. The shorter length of sleeve at 24 enables the retaining flange 20 to be threaded onto the rod 2 close to the shoulder 9. This has the effect of tightly clamping cymbal 4 in place.

FIG. 5 shows fastener 5 in threaded engagement with reduced threaded end portion 3 of stand 1 for playing a standard cymbal 4 in a "loose" mode. Long sleeve portion 22 is threaded onto stand end portion 3 adjacent cup 8 and the cymbal 4 is held between retaining flange portion 20 and cup 8, resting loosely on felt pad 10.

To facilitate the manual threading and unthreading of the fastener 5 to the stand 1, a plurality of ribs 40 (shown best in FIG. 3) are provided spaced along the peripheral edge of flange portion 20. To provide for tighter clamping of the cymbal when the fastener is threaded with the short sleeve portion 24 toward the cup 8 for playing in a "mute" mode, as illustrated in FIG. 4, a tapered portion 42 is provided between the peripheral edge of flange portion 20 and the outside surface of short sleeve portion 24 adjacent the flange. This inward taper toward the short sleeve, results in tighter gripping of the cymbal at its central hole during "mute" mode engagement. A similar tapered portion 44 is provided between the peripheral edge of the flange 20 and the outside surface of long sleeve portion 22 adjacent the flange. This tapering provides for better cymbal vibrational movement when playing in the "loose" mode as illustrated in FIG. 5.

The preferred embodiment is a unitary polymeric structure, such as can be constructed by machining or molding nylon or similar material in accordance with well known techniques. The preferred material is nylon because of its ability to provide strong frictional engagement between the internal threading 27 of the fastener 5 and the reduced threaded end portion 3 of the conventional stand 1. This results in good gripping characteristics and prevents loosening.

The fastener of the present invention offers a simple, reversible fastener for mounting a cymbal or like instrument to a cymbal stand or other suitable support. The fastener includes a retaining flange intermediate a long sleeve portion and a short sleeve portion, and means to selectively attach the fastener to the stand, either long sleeve portion first for "loose" mode cymbal playing or short sleeve portion first for "mute" mode playing. The one-piece structure of the invention offers advantages over conventional wing-nut fasteners, such as fewer parts to become lost and worn, and less tendency to loosen during "loose" playing.

I claim:

1. For use with cymbals having central holes of varying sizes, a reversible one-piece fastener for mounting a cymbal, irrespective of the size of said hole, to the post of a cymbal stand or the like, said fastener comprising a body member having a cymbal-retaining flange portion intermediate a long sleeve portion and a short sleeve portion, and including means to selectively mount the body member, either long sleeve portion or short sleeve portion first, on said cymbal stand post, wherein the flange portion on the side adjacent the short sleeve portion is tapered toward the short sleeve portion, and wherein the flange portion on the side adjacent the long sleeve portion is tapered toward the long sleeve portion, and including gripping means on the flange portion for facilitating manual gripping of the fastener, and wherein the flange, long sleeve and short sleeve portions of said body member are in the general form of coaxially aligned cylinders, and wherein the means to selectively mount the body member to a cymbal post includes internal threading within a bore in at least one of the flanges, long or short sleeve portions for mating with an externally threaded cymbal stand post.

2. The combination of a cymbal having a central hole, a cymbal stand having a post which terminates in a shoulder and reduced externally threaded end portion for either "loose" mode or "mute" mode cymbal playing, a disc washer supported by said shoulder and a felt pad sandwiched between said cymbal and said disc washer, and a one-piece reversible fastener in threaded engagement with said threaded end portion, said fastener comprising a unitary body member having a coaxially aligned generally cylindrical retaining flange portion intermediate generally cylindrical long sleeve and short sleeve portions, said body member further having a central bore therethrough including internal threads located therein, said internal threads being mated for interengagement with the external threads of said reduced end portion whether the fastener is presented long sleeve portion or short sleeve portion toward said post.

3. In combination, a musical instrument, a reversible fastener, and a support for the mounting of said musical instrument, said support having a fastener-receiving element and said musical instrument having a hole through which said fastener-receiving element extends, said fastener comprising a body member having an instrument-retaining flange portion intermediate a long sleeve portion and a short sleeve portion, and including means to affix selectively the body member, either long sleeve portion or short sleeve portion first, to said fastener-receiving element, said fastener being affixed by said means to said fastener-receiving element.

4. The combination of claim 3 wherein the flange portion on the side adjacent the short sleeve portion of the body of the fastener is tapered toward the short sleeve portion.

5. The combination of claim 4 wherein the flange portion on the side adjacent the long sleeve portion of the body of the fastener is tapered toward the long sleeve portion.

6. The combination of claim 3 wherein the flange portion on the side adjacent the long sleeve portion of the body of the fastener is tapered toward the long sleeve portion.

7. The combination of claim 3 wherein the body member of the fastener includes means for facilitating manually gripping thereof.

8. The combination of claim 7 wherein said gripping means comprises a plurality of ribs spaced along a peripheral edge of said flange portion.

9. The combination of claim 3 wherein the flange, long sleeve and short sleeve portions of the body member of the fastener are in the general form of coaxially aligned cylinders.

10. The combination of claim 3 wherein said fastener-receiving element has external threads and said means includes internal threads within a bore of said body member and wherein said fastener is affixed to said element by the engagement of said external and internal threads.

11. The combination of claim 3, 4, 6, 5, 7, 8, 9, or 10 wherein said body member of the fastener comprises a unitary integrated structure.

12. The combination of claim 11 wherein said body member of the fastener is affixed to said fastener-receiving element through said long sleeve portion.

13. The combination of claim 11 wherein said body member of the fastener is affixed to said fastener-receiving element through said short sleeve portion.

14. The combination of claim 11 wherein said musical instrument is a cymbal.

* * * * *